US005370258A

United States Patent [19]

Fair

[11] Patent Number: 5,370,258

[45] Date of Patent: Dec. 6, 1994

[54] BAFFLE DEVICE FOR BEVERAGE CONTAINERS

[76] Inventor: Rick K. Fair, 943 E. Citation La., Tempe, Ariz. 85284

[21] Appl. No.: 228,643

[22] Filed: Apr. 18, 1994

[51] Int. Cl.[5] ..... B65D 23/00

[52] U.S. Cl. ..... 220/719; 220/506; 220/501

[58] Field of Search ..... 220/719, 506, 501, 507, 220/528, 553, 556

[56] References Cited

U.S. PATENT DOCUMENTS

| | | | |
|---|---|---|---|
| 1,454,639 | 5/1923 | Haines | 220/506 |
| 2,204,765 | 6/1940 | McDaniels | 220/506 |
| 2,362,354 | 11/1944 | Clovis | 220/719 |
| 2,428,056 | 9/1947 | Wachsman | 220/719 |
| 3,070,226 | 12/1962 | Mathison | 220/528 |
| 4,627,595 | 12/1986 | Rhodes et al. | 220/506 |
| 4,768,674 | 9/1988 | Prescott | 220/719 |
| 4,842,157 | 6/1989 | Stone-Parker et al. | 220/719 |
| 4,938,375 | 7/1990 | Fantacone | 220/719 |
| 5,233,933 | 8/1993 | McSorley et al. | 220/506 |

*Primary Examiner*—Joseph Man-Fu Moy

*Attorney, Agent, or Firm*—Richard R. Mybeck; Peter B. Scull

[57] ABSTRACT

An insertable baffle device for use in beverage containers to prevent spillage therefrom. The new and unique baffle device has a plurality of substantially vertical, foraminous wing assemblies attached to and extending radially from a foraminous, columnar central member, and an annular member operatively attached substantially near the upper perimeter of the wing assemblies, all of which coact to reduce wave action created by movement of the container and thereby substantially reduce spillage therefrom. The wing assemblies further comprise flanges attached vertically along the outer edges thereof to frictionally engage any of a plurality of beverage containers regardless of their diametric variations.

12 Claims, 1 Drawing Sheet

FIG. 1
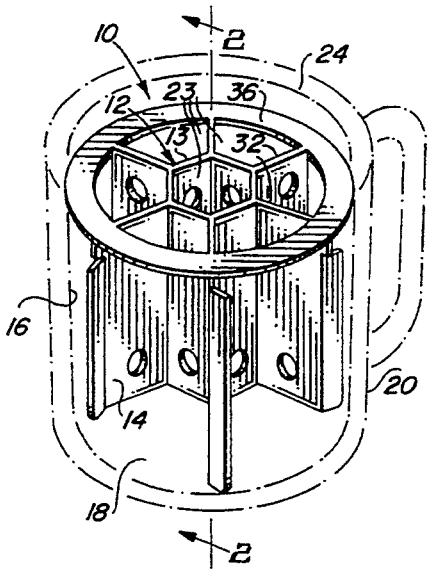
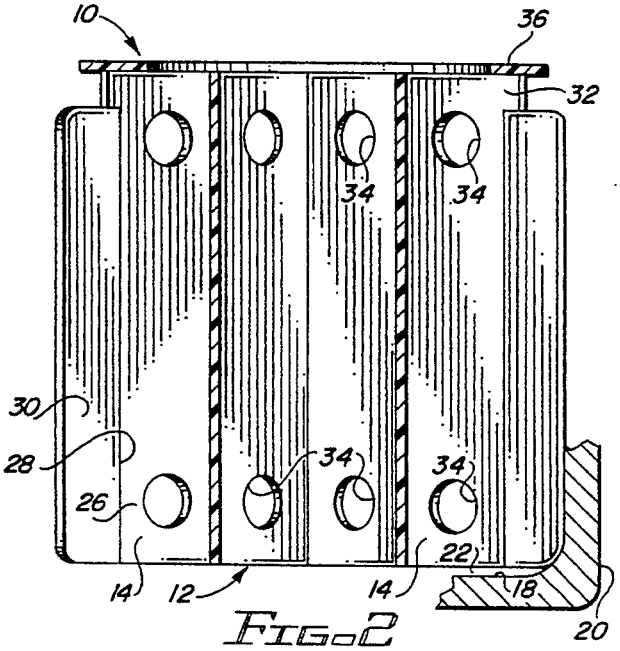
FIG. 2
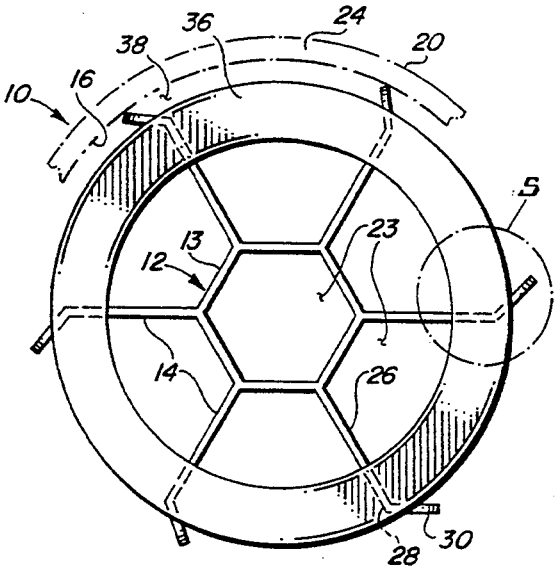
FIG. 3
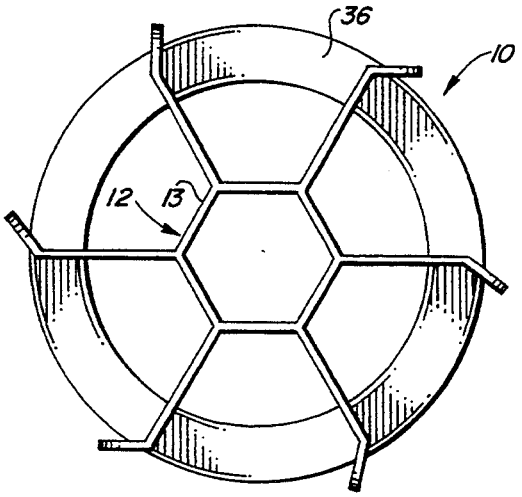
FIG. 4
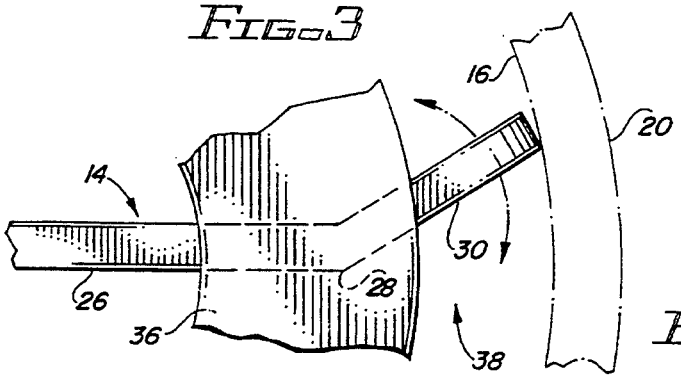
FIG. 5

BAFFLE DEVICE FOR BEVERAGE CONTAINERS

INTRODUCTION

The present invention relates generally to beverage containers and more particularly to a device adapted for insertion into a single serving beverage container to reduce the lateral wave motion of and prevent the subsequent spillage of liquid contained therein.

BACKGROUND OF THE INVENTION

In a highly mobile society, people commonly carry open beverage containers with them while they move about whether they walk, ride or fly. However, when such containers are shook, agitated, or jostled because they are subjected to the normal forces associated with a person's daily movements such as those forces caused by walking, or by automobiles hitting bumps or airplanes running into turbulence, the beverage contained therein forms small waves that often spill from the container.

Several attempts have been made to reduce such wave action by the introduction of various baffle devices into open beverage containers. For instance, Clovis, in U.S. Pat. No. 2,362,354, and Wachsman, in U.S. Pat. No. 2,428,056, each disclose the insertion of devices having a plurality of damping or wing members into a drinking container. Both disclose that their respective wing members are joined at a vertical central axis which is coaxial with the container's axis and are extended radially therefrom to the inner wall of the container. Both further disclose a frictional engagement of the outer ends of the wing members with the container's inner wall. Clovis also discloses flanges attached at the outer ends of the wing members adapted for face-to-face engagement with the inner surface of the container. Wachsman teaches a cover plate attached to the top of the wing members which overlays most of the liquid surface area except for a drinking opening disposed therein. Wachsman's cover plate is employed for the express purpose of maintaining the wing members in a radially spaced deployment and for providing a planular surface suitable for advertising and display indicia.

In another early attempt, Alexander, U.S. Pat. No. 3,400,855, discloses a spillproof container which has a baffle comprising a single, vertical planar member which extends laterally from one interior container wall to the diametrically opposed wall, and vertically from adjacent the bottom of the container to the upper horizontal plane thereof to thereby divide the container into two nearly identical sub-regions. Alexander's baffle has a plurality of apertures or openings randomly disposed in the member and a notch at the bottom thereof to allow free circulation of the liquid between the separate container sub-regions to allow mixing and to maintain a uniform temperature therein.

However, in practice, none of these prior art devices effectively accomplished all of the ultimate desiderata for such a device because they did not completely eliminate the lateral slosh and spillage from the associated beverage container, they were relatively expensive to make, and they were not usable in containers having other than a fixed diameter. It is to more efficiently overcome these problems and to attain the totality of the aforestated desiderata that the present invention is directed.

BRIEF SUMMARY OF THE INVENTION

The present invention relates to a new and unique baffle device for insertion into an open, single serving beverage container to prevent the contents from spilling when the container or its supporting surface is moved. Deficiencies of the prior art are overcome by the present invention which comprises a device having a plurality of substantially vertical, foraminous wing assemblies extending radially from and spaced generally equilaterally about a foraminous, columnar central member. The central member comprises a hollow, open-ended cylindrical or polygonal shaft with a preselected diameter of from about $\frac{1}{4}$ to about $\frac{1}{2}$ of the diameter of the container with which it is used. Each wing assembly is further provided, at the outer edge thereof, with a flexible angularly disposed vertical flange which is operative to provide a frictional fit against the inner wall of the beverage container into which the baffle device is placed irrespective of the diametric variations of the plurality of containers with which this device could be used. The device further comprises an annular member attached to the upper, outer perimeter of the radial wing assemblies and which extends transversely thereof.

The several wing assemblies coact with the central member to define a plurality of sub-regions within the container to provide an effective damping of fluid motion within each sub-region and to substantially reduce the amplitude of a liquid wave formed by movement of the container or its supporting surface. Hence, spillage from the container is substantially eliminated. The annular member provides additional protection against surging near the container rim thereby further decreasing the probability of unwanted spillage.

While the sub-regions formed by the wing assemblies provide effective wave damping action, the sub-region defined by the central member provides substantially more wave damping than is otherwise possible using a radial wing baffle device alone. In simplified physical terms, when a beverage container is bumped or jarred by a sudden movement, the liquid is accelerated into a moving waveform. This acceleration takes place with respect to the container when the liquid moves from a standstill (or zero velocity) to some terminal velocity depending on the length of its linear movement. As the waveform increases in velocity, so too, does the wave height. Once put in motion, the waveform continues to build as it travels in a straight line until stopped by an outside force. Unbaffled, such a waveform builds until it reaches the diametrical opposite wall of the container. Waveforms baffled by prior devices could increase in amplitude until the waveform propagated itself across half the diameter of the container. The present invention prevents such an increase in amplitude by incrementally baffling the waveform before it can attain a linear distance equivalent to that allowed by prior art devices.

Accordingly, a primary object of the present invention is to provide a new and unique baffle device for insertion into beverage containers which will reduce and substantially eliminate spillage from such containers.

A further object of the present invention is to provide a novel baffle device for insertion into beverage containers which has a central member and a plurality of wing assemblies which coact to form a plurality of sub-regions which coact to greatly reduce the amplitude of any wave motion induced in the liquid contained therein by external forces applied thereto.

Another object of the present invention is to provide a novel baffle device for insertion into a beverage container having an annular member disposed on the upper perimeter of a plurality of radially extending wing assemblies and coacting therewith to substantially offset surging and deter the spillage of liquid from the container.

Still another object of the present invention is to provide a novel baffle device having flexible angular flanges attached vertically along the outer edge of each of a plurality of wing assemblies to frictionally engage the inner wall of the container into which it is inserted and thereby readily adapt the device for use with a number of such containers having different inner diameters.

These and still further objects as shall hereinafter appear are readily fulfilled by the present invention in a remarkably unexpected fashion as will be readily discerned from the following detailed description of an exemplary embodiment thereof especially when read in conjunction with the accompanying drawings in which like parts bear like numerals throughout the several views.

BRIEF DESCRIPTION OF THE DRAWINGS

In the drawings:

FIG. 1 is an isometric view of a typical beverage container having inserted therein a baffle device embodying the present invention;

FIG. 2 is a cross-sectional view of a baffle device embodying the present invention taken on line 2—2 of FIG. 1;

FIG. 3 is a top plan view of a beverage container with a baffle device embodying the present invention operatively installed therein;

FIG. 4 is a bottom plan view of a baffle device of the present invention; and

FIG. 5 is an enlarged sectional view of area 5 of FIG. 3.

DESCRIPTION OF PREFERRED EMBODIMENT

The present invention relates generally to spill-proof beverage containers and more particularly to a novel and unique baffle device 10 for insertion into a substantially cylindrical, single serving beverage container 20 to reduce spillage arising from wave action created by motion of the liquid disposed within container 20.

As shown in FIGS. 1–4, baffle device 10 comprises a substantially vertical central member 12 which has a hollow, open-ended columnar shape with either a cylindrical or polygonal perimeter 13 having a preselected cross-sectional diameter. When inserted fully into container 20, central member 12 is disposed in vertical, substantially coaxial relationship with the vertical central axis of container 20.

Baffle device 10 further comprises a plurality of substantially vertical wing assemblies 14 which are attached to and extend radially outwardly from perimeter 13 of central member 12 to inner vertical surface 16 of container 20. Wing assemblies 14 frictionally engage surface 16 and coact therewith to suspend baffle device 10 in spaced superposed relationship to bottom surface 18 of container 20. Thus, baffle device 10 coacts with container 20 to define a common reservoir 22 therebetween beneath the sub-regions 23 defined by baffle device 10 as will be hereinafter described. Reservoir 22 permits circulation of the liquid disposed within container 20 under all sub-regions 23 so that when container 20 is tilted in the well-known or natural manner for drinking to the "last drop", all of the liquid will flow through reservoir 22 and into the particular sub-region through which the drinking person has chosen to drink. Tilting container 20 in this way causes this particular sub-region to be situated below the others so gravity will cause the flow pattern herein described for emptying container 20.

Further, the vertical height of baffle device 10 is predetermined such that the horizontal plane defined by the top of baffle device 10 is substantially co-planer with the horizontal plane defined by rim 24 of container 20. Thus, baffle device 10 may be made in various heights for use in containers having different depths.

Central member 12 may, in cross-section be circular thereby defining a cylinder (not shown), or, alternatively as shown, may be an n-sided polygon such as the hexagon shown when $n=6$. As shown in FIGS. 3 and 4, n may be equal to the number of wing assemblies 14, such that each wing assembly 14 may be attached at each of the n conjunctions or angles of the adjacent sections or sides of the polygon. Whether shaped cylindrically or polygonally, the preferred embodiment defines a central member 12 with each wing assembly 14 extending radially outwardly therefrom in substantially equi-spaced relationship between each of the adjacent wing assemblies 14.

As most clearly shown in FIGS. 3, 4 and 5, each wing assembly 14 comprises a body portion 26, which extends from central member 12 to an outer edge 28, and a flange portion 30. Preferably, each flange portion 30 is pivotally attached vertically along each outer edge 28. Each flange portion 30 extends angularly from the substantially vertical plane of each body portion 26 to provide frictional engagement with inner vertical surface 16 of container 20 when baffle device 10 is inserted therein. Each flange portion 30 is pivotally attached and moveable relative to body portion 26 to vary the effective radial length of each wing assembly 14 which makes baffle device 10 adaptable to a plurality of containers 20 having different internal diameters. Each flange portion 30 extends vertically from a point adjacent the bottom edge of its associated body portion 26 to a point adjacent the uppermost edge 32 of each wing assembly 14.

A plurality of apertures or foramina 34 are formed in each wing assembly 14 and in central member 12 to allow liquid to flow therethrough and circulate between the sub-regions defined by baffle device 10 within container 20;

As shown in FIGS. 1–5, an annular member 36 is seated upon and attached to the uppermost edge 32 of wing assemblies 14 and extends transversely thereof in generally perpendicular relationship to wing assemblies 14 to provide additional resistance to the spillage of liquid from container 20. Annular member 36 is seated securely upon baffle device 10 in coaxial relationship to the central vertical axis of central member 12 and positioned so that it is substantially near the outer perimeter of wing assemblies 14. Further, the transverse extension of annular member 36 extends from a point substantially near the outer edge 28 of body portion 26 inwardly a predetermined distance toward the central vertical axis of container 20. However, an open drinking space 38 is preferably provided between annular member 36 and container 20.

In a preferred practice of the present invention, baffle device 10 will be formed from a non-leachable plastic material such as polyvinylchloride, polypropylene, styrofoam or the like. Baffle device 10 may be formed by injection molding, or alternatively, it may be formed by cutting sheet plastic materials of a suitable thickness in which case central member 12, wing assemblies 14, flange portions 30 and annular member 36 will be attached as described using suitable non-toxic adhesives or cements.

In another practice of the present invention, baffle device 10 may be made inexpensively out of a stiff paper material or thin plastic so that baffle device 10 is suitable for one-time use and disposable.

In use, baffle device 10 is inserted into beverage container 20, either prior to or subsequent to placing a desired liquid such as coffee, tea, lemonade, milk, soft drinks or the like into container 20. The user is then free to carry container 20 with him or her while walking, driving or riding in a vehicle, or otherwise traveling about while also having the reasonable assurance that the liquid contained within container 20 will not spill or splash due to the movement of the user or container 20. The small sub-regions created by the coaction of foraminous central member 12 with foraminous wing assemblies 14, break down the wave action by not allowing the waves to become large enough to splash over container rim 24. The action of upper perimeter annular member 36 coacts with central member 12 and wing assemblies 14 to further block what waves are created away from container rim 24 and to thereby substantially eliminate the threat of spillage.

From the foregoing, it is readily apparent that a useful embodiment of the present invention has been herein described and illustrated which fulfills all of the aforestated objectives in a remarkably unexpected fashion. It is of course understood that such modifications, alterations and adaptations as may readily occur to the artisan confronted with this invention are intended within the spirit of this disclosure which is limited only by the scope of the claims appended hereto.

Accordingly, what is claimed is:

1. A baffle device for insertion into a beverage container to prevent liquid spillage therefrom, said device comprising:

a columnar central member;

a plurality of wing assemblies, each being operatively connected to said central member and extending radially outwardly therefrom, each of said wing assemblies having an outer edge for frictionally engaging said container;

each said wing assembly having a plurality of foramina defined therethrough to allow liquid to flow therethrough;

said central member having a plurality of foramina defined therethrough to allow liquid to flow therethrough; and a transversely extending annular member in generally perpendicular relationship with and attached to each said wing assembly in coaxial relationship with said central member.

2. A device according to claim 1 in which said central member is cylindrical and said wing assemblies extend radially outwardly therefrom in equi-spaced relationship between each of the adjacent wing assemblies.

3. A device according to claim 1 in which the cross-section of said central member is a polygon having a plurality of angles each intermediate a pair of adjacent sections of said polygon and each of said wing assemblies attached to and extends radially outwardly from a different one of said angles in said central member.

4. A device according to claim 1 in which said wing assembly comprises a body portion having an outer edge and a flange portion, said flange portion being pivotally attached to said outer edge of said body portion and moveable relative thereto to vary the radial length of said wing assembly.

5. A device according to claim 2 in which said wing assembly comprises a body portion having an outer edge and a flange portion, said flange portion being pivotally attached to said outer edge of said body portion and moveable relative thereto to vary the radial length of said wing assembly.

6. A device according to claim 3 in which said wing assembly comprises a body portion having an outer edge and a flange portion, said flange portion being pivotally attached to said outer edge of said body portion and moveable relative thereto to vary the radial length of said wing assembly.

7. A spill-proof beverage container for travelers comprising a container containing a liquid beverage and a device seated therewithin to divide said container into a plurality of subregions, said device having:

a columnar central member;

a plurality of wing assemblies, each being operatively connected to said central member and extending radially outwardly therefrom, each of said wing assemblies having an outer edge for frictionally engaging said container;

each said wing assembly having a plurality of foramina defined therethrough to allow liquid to flow therethrough;

said central member having a plurality of foramina defined therethrough to allow liquid to flow therethrough; and a transversely extending annular member in generally perpendicular relationship with and attached to each said wing assembly in coaxial relationship with said central member.

8. A spill-proof beverage container according to claim 7 in which said central member is cylindrical and said wing assemblies extend radially outwardly therefrom in equi-spaced relationship between each of the adjacent wing assemblies.

9. A spill-proof beverage container according to claim 7 in which the cross-section of said central member is a polygon having a plurality of angles each intermediate a pair of adjacent sections of said polygon and each of said wing assemblies is attached to and extends radially outwardly from a different one of said angles in said central member.

10. A spill-proof beverage container according to claim 7 in which said wing assembly comprises a body portion having an outer edge and a flange portion, said flange portion being pivotally attached to said outer edge of said body portion and moveable relative thereto to vary the radial length of said wing assembly.

11. A spill-proof beverage container according to claim 8 in which said wing assembly comprises a body portion having an outer edge and a flange portion, said flange portion being pivotally attached to said outer edge of said body portion and moveable relative thereto to vary the radial length of said wing assembly.

12. A spill-proof beverage container according to claim 9 in which said wing assembly comprises a body portion having an outer edge and a flange portion, said flange portion being pivotally attached to said outer edge of said body portion and moveable relative thereto to vary the radial length of said wing assembly.

* * * * *